US008022647B1

(12) United States Patent
Davis et al.

(10) Patent No.: US 8,022,647 B1
(45) Date of Patent: Sep. 20, 2011

(54) GAS WATER HEATER ACTUATOR

(76) Inventors: Jeffrey Pat Davis, Berry Creek, CA (US); Larry Glenn Davis, Aberdeen, WA (US)

( * ) Notice: Subject to any disclaimer, the term of this patent is extended or adjusted under 35 U.S.C. 154(b) by 176 days.

(21) Appl. No.: 12/612,823

(22) Filed: Nov. 5, 2009

Related U.S. Application Data

(60) Provisional application No. 61/183,000, filed on Jun. 1, 2009.

(51) Int. Cl.
*H02P 3/20* (2006.01)

(52) U.S. Cl. ..... 318/293; 318/300; 236/91 D; 236/93 R; 165/200; 165/215; 165/253; 73/1.06; 73/1.16; 137/489; 337/14

(58) Field of Classification Search ..... 318/293, 318/300; 236/91 D, 93 R; 165/200, 215, 165/253; 73/1.06, 1.16; 137/489; 337/14
See application file for complete search history.

(56) References Cited

U.S. PATENT DOCUMENTS

| | | | | | |
|---|---|---|---|---|---|
| 3,902,351 | A * | 9/1975 | Kreps | 374/1 |
| 4,016,402 | A * | 4/1977 | Scott | 392/464 |
| 4,166,944 | A * | 9/1979 | Scott | 392/463 |
| 4,235,323 | A * | 11/1980 | Dykzeul | 192/95 |
| 4,346,835 | A * | 8/1982 | Trotter et al. | 236/24 |
| 4,549,160 | A | 10/1985 | McGhee | |
| 4,564,003 | A * | 1/1986 | Iwanicki et al. | 126/615 |
| 4,842,044 | A * | 6/1989 | Flanders et al. | 165/244 |
| 5,199,385 | A * | 4/1993 | Doss | 122/14.22 |
| 5,312,036 | A * | 5/1994 | Trotter | 236/21 B |
| 5,347,956 | A | 9/1994 | Hughes | |
| 6,308,895 | B1 * | 10/2001 | Atxa et al. | 237/2 A |
| 6,920,843 | B1 | 7/2005 | Wilson | |
| 2009/0223572 | A1 * | 9/2009 | Roschke et al. | 137/489 |

* cited by examiner

*Primary Examiner* — Rita Leykin
(74) *Attorney, Agent, or Firm* — William Bodnar

(57) ABSTRACT

A system and method for enabling automated activation of a temperature control shaft of a gas valve includes an electric motor having a motor shaft and integral coupler, wired to a relay control circuit and controlled by a standard electric timer device.

20 Claims, 4 Drawing Sheets

GAS WATER HEATER ACTUATOR

CROSS REFERENCE TO RELATED APPLICATIONS

This application claims priority from U.S. Provisional Patent Application No. 61/183,000 filed Jun. 1, 2009. The contents of U.S. Provisional Patent Application 61/183,000 are incorporated herein by reference.

FIELD OF THE INVENTION

This invention relates to natural gas and propane water heaters and more particularly, an actuator apparatus utilized with a timer device to control the on and off operation of the water heater gas control valve to provide better efficiency to the operation of the gas water heater.

BACKGROUND OF THE INVENTION

Typically, gas water heaters are fueled by either natural or propane gas. The hot water heater provides a thermostat wherein the temperature within the hot water heater is maintained at a predetermined temperature established by the thermostat. When the water within the hot water heater reaches a temperature below the predetermined temperature set by the thermostat, the water heater begins to heat the water within the hot water heater until the water reaches the predetermined set temperature.

The continuous reheating of the water within the hot water heater is inherently an inefficient process because the water within the hot water heater is maintained at a predetermined temperature whether hot water is needed or not.

A more efficient operation would be to turn the water heater gas control valve off or to a lower setting during vacations, work schedules, evenings and other times when hot water is not needed. Thus the application of this invention will greatly reduce the consumption of fossil fuels and energy cost to operate a gas hot water heater.

SUMMARY OF THE INVENTION

Embodiments of the present invention resolve the above mentioned shortcomings by providing an actuator apparatus that can be used with a timer to programmably control the operation of a gas hot water heater. The apparatus is referred to herein as an actuator apparatus or assembly and consists of components to be coupled to the gas control valve of a gas hot water heater to operate at predetermined times that have been set on a programmable timer connected to the apparatus. Most conventional timer devices can be utilized with the actuator apparatus. The external power for the actuator apparatus and the timer is typically suppliant through the household AC system.

An actuator is a mechanical device for moving or controlling a mechanism or system. In embodiments of the present invention, the actuator apparatus or assembly is attached to a gas water heater valve for the purpose of controlling the operation of the water heater in accordance with settings of timer connected to the assembly.

In its basic configuration, the actuator apparatus is comprised of a motor having a motor shaft, a coupler attached to the motor shaft, an attachment component to affix the motor coupler to a gas control valve, an internal power supply and an electrical control system.

These and various other novel features and advantages of the present invention will be readily understood by those skilled in the related arts with reference to the following description taken in conjunction with the accompanying drawings.

DETAILED DESCRIPTION OF THE PREFERRED EMBODIMENT

Figure 1:
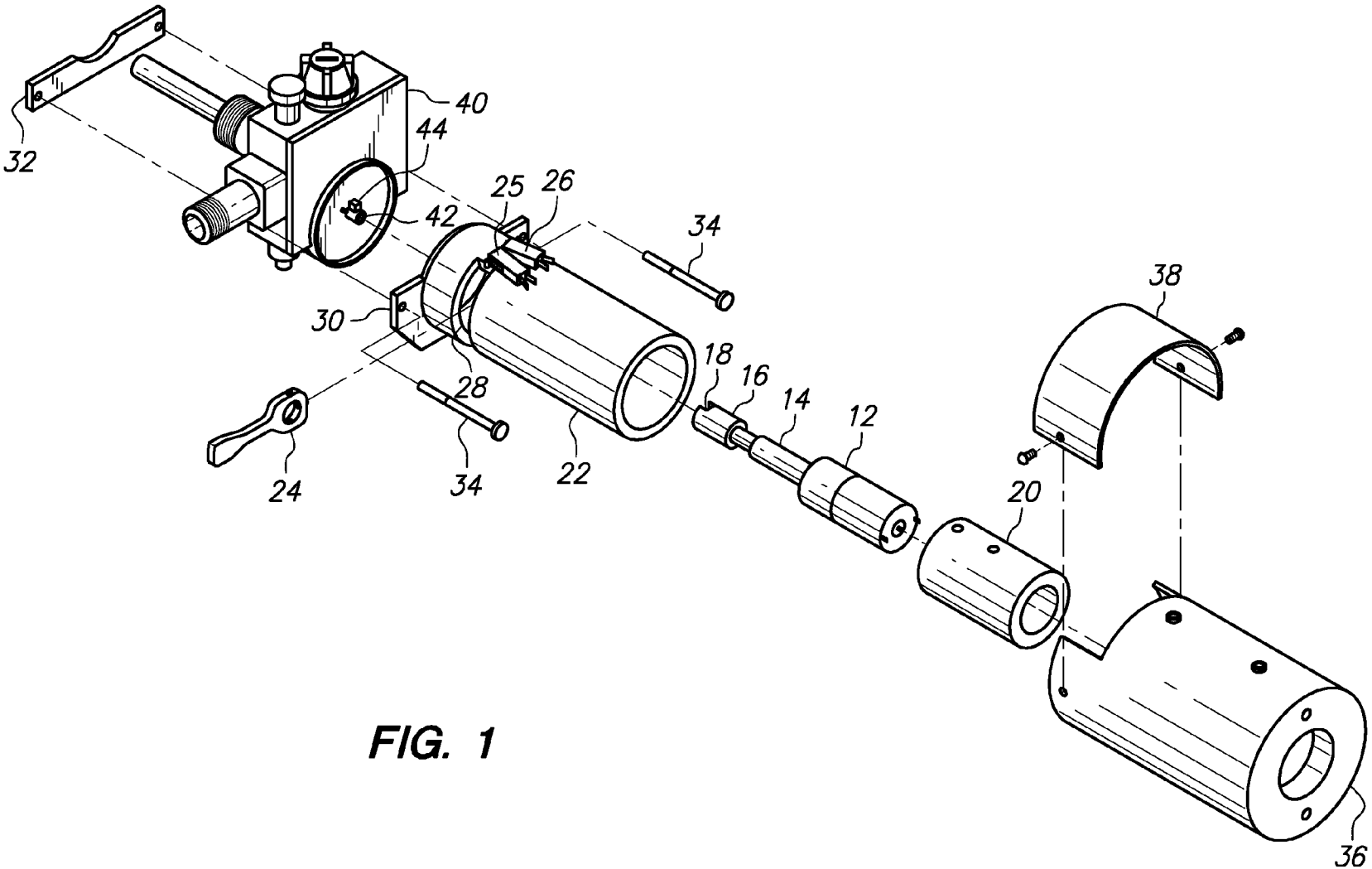
FIG. 1 is an exploded perspective view of the components of the gas water heater actuator apparatus and their relative order of position for attachment to a gas water heater temperature control valve.

Referring to FIG. 1, which shows the general features of a preferred embodiment of the invention, the actuator assembly 10 is shown in its orientation and position with respect to a typical gas water heater control valve 40. In its basic form, the actuator assembly is comprised of a gear motor 14 capable of being connected to a gas water heater control valve 40 via use of a coupler 16 and support hardware.

The gear motor 12 as shown in FIG. 1 typically contains at least one shaft 14 which can be used to connect to a coupler 16. The coupler is connected to the gear motor shaft at one end and it has an opening 18 at the opposite end that is utilized to connect to the gas water heater control valve 40.

The gear motor will typically fit into a gear motor housing 20 which in turn is contained within the first actuator housing 22. The switch activation arm 24 is attached to the gear motor shaft 14. Directional switches 25, 26 are mounted on the top of the first actuator housing 22. The activator arm travels within the opening or slot 28 in the first actuator housing 22 to activate, actuate or trip the directional switches. An electrical wire harness (not shown) is connected to the directional switches.

The actuator assembly 10 is aligned with and connected to the gas valve 40 utilizing the actuator assembly mounting bracket 30 and the gas valve mounting bracket 32. Bolts 34 are typically used with the brackets.

Figure 2:
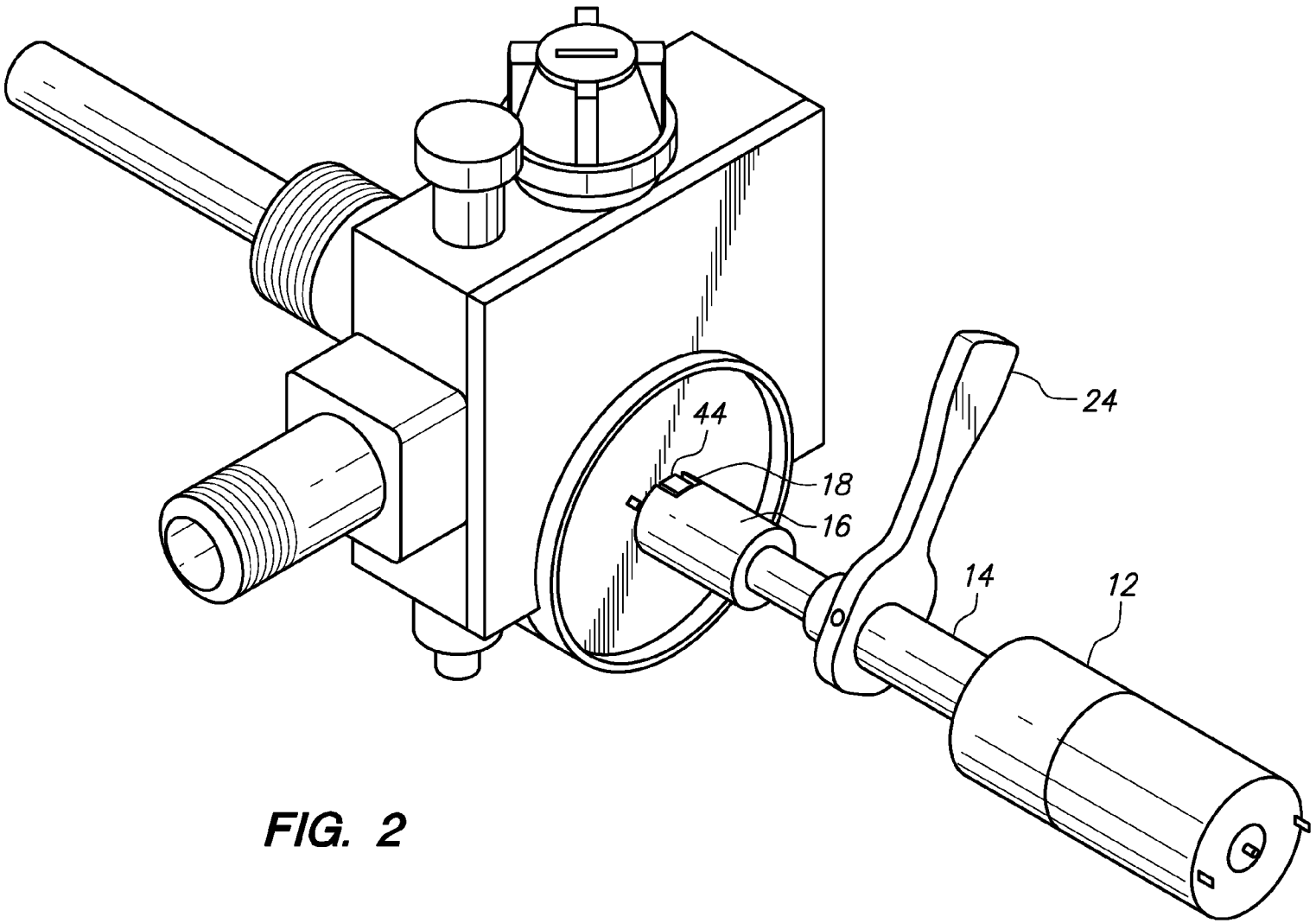
FIG. 2 is a view of the coupler attached to a gas water heater temperature control valve.

The gas water heater valve has a temperature control dial (not shown) that is attached to the gas valve temperature control shaft 42. The temperature control shaft 42 typically has a protuberance 44 attached to or protruding from the temperature control shaft 42. FIG. 2 shows this protuberance 44 aligned with a notch or opening 18 on the coupler 16.

Figure 3:
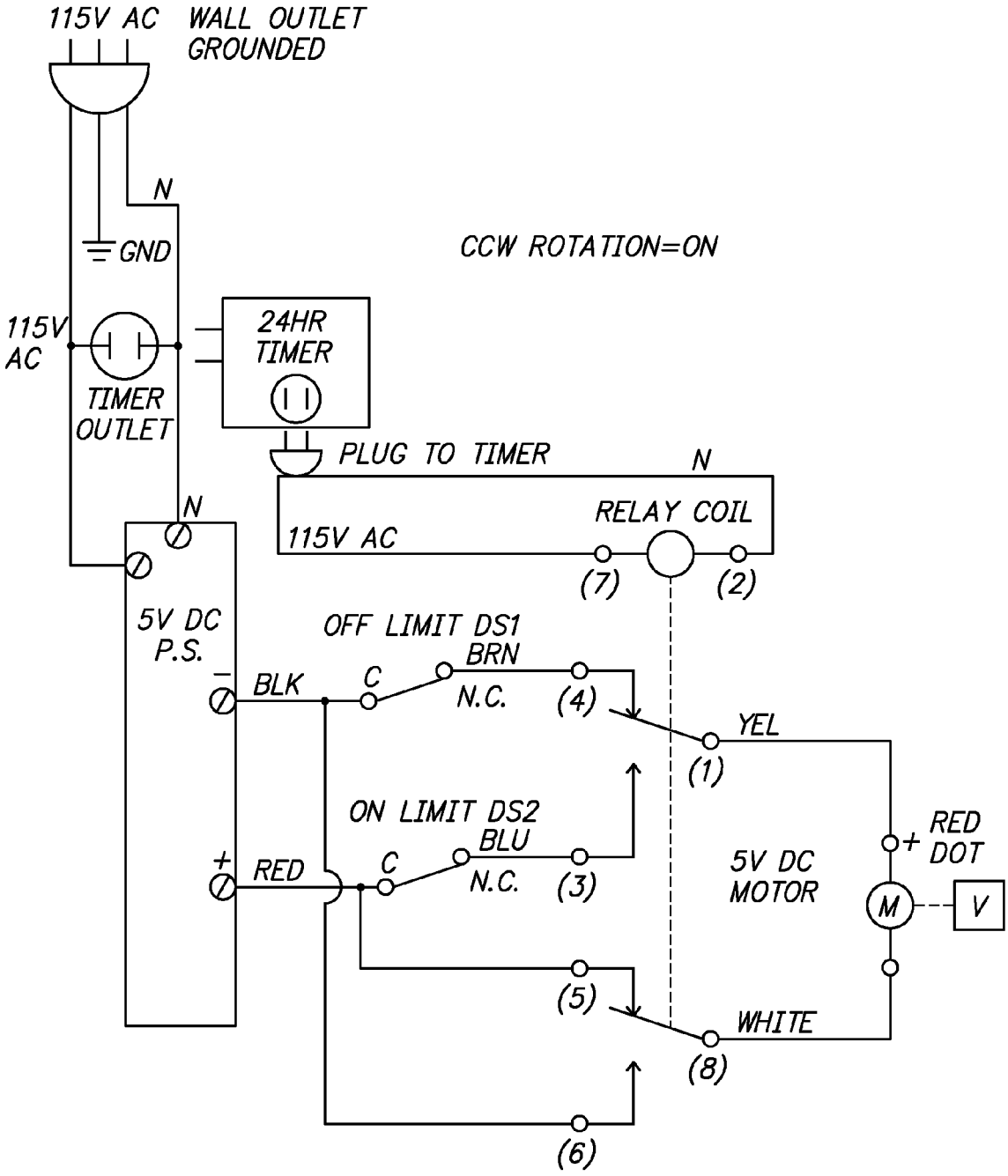
FIG. 3 and FIG. 4 show schematics of an embodiment of an electrical configuration for operating the apparatus.
Figure 4:
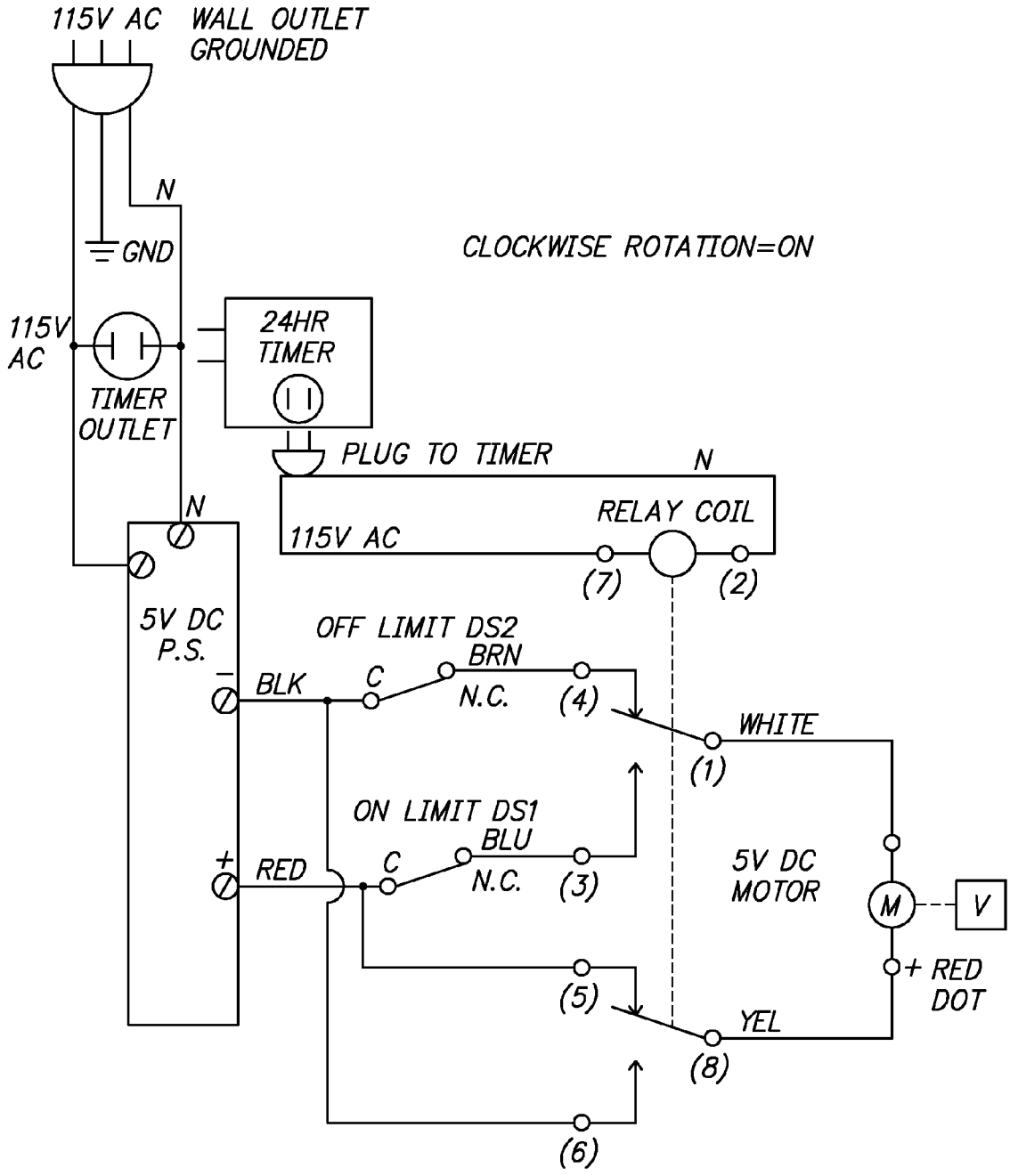

To install the apparatus on a gas water heater, one would first determine if the temperature control dial is rotated clockwise to attain a higher temperature setting or counterclockwise. This will dictate which wiring harness to use. The schematic shown in FIG. 3 represents the wiring harness assembly utilized when the higher temperature setting is achieved by rotating the temperature dial in a counterclockwise direction. The schematic shown in FIG. 4 represents the wiring harness assembly utilized when the higher temperature setting is achieved by rotating the temperature dial in a clockwise direction. Assuming the correct wiring harness is present, one would utilize the following steps to install the apparatus.

Step 1: Turn the water temperature dial on the gas water heater valve to the lowest setting.

Step 2: Remove the water heater temperature dial from the gas valve.

Step 3: Align the actuator assembly so that the directional switches 25, 26 are facing up and the two mounting bolt holes in the mounting bracket 30 are approximately parallel to the floor.

Step 4: Rotate the motor shaft 14 with the switch activation arm 24 until the notch 18 in the coupler 16 is lined up with the shaft 42 and protuberance 44 on the water heater gas valve.

Step 5: Slide the gas valve actuator towards the gas valve. The coupler 16 will slide over the shaft on the gas valve and the protuberance 44 will be engaged within the notch 18 of the coupler 16.

Step 6: Secure the two mounting bracket bolts 34 through the holes in the actuator assembly mounting bracket 30 and into the pre-threaded mounting bracket 32 positioned behind the gas water heater valve 40.

Step 7: Plug the power cord (that supplies electricity to the power supply) into an external power supply (outlet). Plug the timer cord (that supplies power to the relay) into a timer that is set in the "OFF" position. Plug the timer into an external power (outlet).

Step 8: Set the timer to turn on and off as applicable.

The internal power supply is typically 5 VDC and remains powered at all times when the apparatus is connected to an external AC power supply. A 115V relay coil is controlled by the timer. When the timer is in the "ON" position, a relay coil is energized and a set of contacts close to pass 5V DC to the motor. The motor turns the gas valve in the appropriate direction to reach the desired heating setting (i.e., the counterclockwise direction (FIG. 3) or the clockwise direction (FIG. 4)). When the gas valve is rotated to reach the desired heating setting the switch activation arm, having rotated along with the motor shaft, activates a directional switch which opens the relay directional control circuit and stops the motor.

When the timer is in the "OFF" position, the relay coil de-energizes; closing another set of contacts on the relay and opening the contacts for the other direction and the motor turns in the opposite direction until the switch activation arm activates the directional switch which opens the control circuit and interrupts the 5 Volts DC from the power supply and stops the motor. This deactivates the water heater gas valve.

A typical wiring setup is discussed herein presuming the wall plug is plugged in and the timer has been set and activated. On some water heaters, the temperature control dial is rotated in the counterclockwise direction to attain a higher temperature setting. The wiring schematic shown in FIG. 3 would be utilized with an actuator when the counterclockwise temperature dial is present. The wiring schematic shown in FIG. 4 is appropriate when the temperature control dial on the gas valve is rotated in the clockwise direction to attain a higher temperature setting for the water heater.

Utilizing the schematic in FIG. 4, the path of current can be traced from the negative terminal (−) on Power Supply (PS) to the positive terminal (+) on the PS to explain the operation of the valve timer. This will explain the operation of the valve electronics control that turns the gas valve off and on.

Using the FIG. 4 (clockwise rotation=on) schematic diagram, start at the Negative (−) terminal at the Internal Power Supply P.S. (BLK wire). The BLK wire is connected to two devices, a relay at pin 6, and the OFF LIMIT switch DS2 at the Common (C) terminal. OFF LIMIT directional switch DS2 corresponds to part #26 in FIG. 1. The relay at pin 6 is a "Normally Open" contact. There will be no current passing through the relay at pin 6 because the contact is open. The other connection at the Common (C) terminal of the OFF LIMIT switch DS2 is passing current to its "Normally Closed" (N.C.) contact, then to pin 4 of the relay (BRN wire).

Pin 4 on the relay is a Normally Closed contact connected to Pin 1 in the relay, which is connected to one of the motor terminals (WHITE wire) passing current to the motor. The other side of the motor is connected to pin 8 of the relay. (YEL wire)

Pin 8 of the relay is connected through a Normally Closed contact in the relay to pin 5, which is connected to the positive side (+) RED wire of the internal power supply P.S. completing the circuit, driving the motor and moving the valve to the OFF position.

The red wire is also connected to the ON LIMIT switch DS1 Common (C) terminal which is connected to its Normally Closed Contact, (BLU wire). But no current will flow in this direction, because pin 3 on the relay is Normally Open until the relay is activated.

When temperature control shaft on the gas valve reaches the position where the water heater setting is in the OFF position a switch activation arm (#24 on FIG. 1) will activate (open) the OFF LIMIT switch. When the OFF LIMIT switch opens, the current path to the motor is interrupted and the motor stops.

When the timer comes ON and sends 115 V AC to the relay coil [(7) (2)], the relay contacts change position (from (4) to (3) and from (5) to (6)) and drive the motor in the opposite direction by allowing current to first pass from the negative terminal on the internal power supply (P.S.) through pin 6 of the relay to pin 8 of the relay. The armature on the relay has moved from pin 5 to pin 6 allowing current to pass to pin 8 which is wired to the motor.

The other side of the motor is wired to pin 1 on the relay (WHITE wire). Because the relay is actuated, the armature is moved to pin 3 from pin 4 which allows current to flow through the ON LIMIT switch DS1 from the Normally Closed (N.C.) contact to the Common contact (C) which is wired to the positive terminal of the P.S.

The motor activation causes the temperature control shaft on the gas valve to rotate to where the water heater setting is in the ON position at which point the switch actuator arm 24 actuates the ON LIMIT switch which opens and interrupts the current flow and stops the motor.

When the timer shuts off, the relay reverses contacts and drives motor to OFF position again. This completes the cycle for actuating the valve assembly.

GLOSSARY OF TERMS

Activator Arm: A physical component attached orthogonal or approximately orthogonal to the motor shaft. The activator arm rotates along with the motor shaft and communicates with one or more sensors to facilitate operation of the motor.

Actuator: The actuator assembly encompasses at least the following basic components: a motor, motor shaft, activator arm, coupler, internal power supply and electronic control system.

Electrical switch component: The electrical switch components are typically directional switches that ultimately control the direction of the motor shaft and actuator arm however all equivalent electrical sensor components are contemplated. It is contemplated that only one directional switch could be utilized. The directional switches described herein are typically activated when contacted by the activator arm. Other types of electrical components are contemplated including optic and electrical sensors which may or my not necessitate physical contact with the activator arm to actuate, trip or communicate with the switch to activate the motor in response to the position of the activator arm.

Electronic control system: This system consists of the wiring and electrical components to control the movement of the motor and actuator arm to effectuate the desired movement of the gas water heater temperature control valve.

External power supply: This power supply is typically an AC power source but any type of power supply capable of providing power to the internal power supply is contemplated including, but not limited to, AC or DC power sources, e.g., generators, solar or wind power, and batteries.

Internal power supply: The internal power supply is typically a DC power supply or an AC transformer however any applicable power supply known by those skilled in the art is contemplated.

CONCLUSIONS, OTHER EMBODIMENTS, AND SCOPE OF INVENTION

A preferred embodiment of the control system has been shown and described herein. Another control system contemplated utilizes one double pole, double throw relay and a 115 volt AC coil. Another control system utilizes one 5 volt DC power supply that transforms 115 VAC into 5 volts DC to drive a DC motor.

This activator apparatus could also operate utilizing a low voltage reversing AC motor by replacing the power supply with a transformer and replacing the motor with an AC reversing motor. The wiring would be adapted to accommodate this configuration. The limit switches and relay could be utilized but would be rewired and a transformer would provide the internal power supply to replace the internal DC power supply.

Thus, although there have been described particular embodiments of the present invention of a new and useful device, it is not intended that such references be construed as limitations upon the scope of this invention except as set forth in the following claims.

The invention claimed is:

1. A system for enabling automated activation of a temperature control shaft of a gas valve comprising:

an electric motor including an elongate motor shaft wired to a relay control circuit and controlled by an electric timer;

a coupler affixed to the motor shaft at the free end of the motor shaft, the coupler for coupling the motor shaft to the temperature control shaft;

at least one switch for interrupting current flow to the motor from a connected power supply; and a switch activation arm adjustably affixed to the motor shaft.

2. The system of claim 1 wherein the gas valve controls a water heater.

3. The system of claim 1 wherein the coupler is cylindrical and notched on the edge opposite of the motor, the notch adapted to engage a protuberance on the temperature control shaft.

4. The system of claim 1 wherein the motor shaft rotates in a clockwise or in a counterclockwise direction dependant on the direction of current applied to the motor.

5. The system of claim 1 wherein the rotation of the motor shaft urges the temperature control shaft to rotate in kind due to the engagement thereon of the coupler.

6. The system of claim 4 wherein the switch activation arm trips the at least one switch interrupting current to the motor halting further rotation of the temperature control shaft.

7. The system of claim 1 modularly disposed between the gas valve and an electric timer.

8. An actuator for inducing rotation of a temperature control shaft of a gas water heater comprising:

a motor having a motor shaft and an electrical connection to a power supply for carrying current to the motor, the motor connected to and controlled by a relay control circuit, the circuit energized and de-energized by an electric timer;

a cylindrical motor housing for enclosing the motor;

a cylindrical actuator housing for enclosing the motor housing and motor, the actuator housing having an elongate opening provided there through and extending partially there around;

a coupler affixed at one end to the motor shaft for coupling the motor shaft to the temperature control shaft;

at least one switch mounted to the outer surface of the actuator housing proximal to the elongate opening, the at least one switch for interrupting current from the power supply to the motor;

a switch activation arm adjustably affixed to the motor shaft and extending through the elongate opening in the actuator housing, the switch activation arm for tripping the at least one switch; and a pair of mounting brackets for mounting the actuator to a gas control valve of the water heater.

9. The actuator of claim 8 wherein the motor shaft is coupled to the temperature control shaft by virtue of the notch on the coupler fitted around a protuberance on the temperature control shaft.

10. The actuator of claim 9 wherein there are two switches, one for stopping the motor shaft and switch activation arm from continuing rotation in one direction and the other for stopping the motor shaft and switch activation arm from continuing rotation in the opposite direction.

11. The actuator of claim 8 wherein the power supply provides approximately five volts of direct current (DC) to operate the motor.

12. The actuator of claim 8 wherein the relay control circuit has two contact sets operable to open and close alternately to control the direction of the motor shaft.

13. The actuator of claim 8 wherein the motor is a low voltage alternating current (AC) motor.

14. A method for enabling automatic actuation of a temperature control shaft of a gas valve of a hot water heater using a system comprising an electric motor wired to a relay control circuit and controlled by an electric timer, the motor including an elongate motor shaft, a coupler for coupling the system to the temperature control shaft, the coupler affixed to the motor shaft at the free end of the motor shaft, at least one switch for interrupting current flow to the motor from a connected power supply, and a switch activation arm adjustably affixed to the motor shaft comprising the steps:

(a) removing the dial on the hot water heater to expose the temperature control shaft;

(b) aligning the system over the temperature control shaft coupling the motor shaft to the temperature control shaft;

(c) using a pair of mounting brackets and support hardware, including at least one housing for enclosing the system, securing the system over the temperature control shaft to the gas valve the motor shaft coupled to the temperature control shaft;

(d) connecting the system to a power supply and to a programmable timer and plugging in the power supply and timer; and (e) programming the timer to operate the motor of the system to turn the temperature control shaft in one direction at a first pre-programmed time and to turn the temperature control shaft in the opposite direction at a second pre-programmed time, the activation arm stopping rotation of the motor in either direction by engaging the at least one switch to interrupt power to the motor until the next programmed time wherein the temperature control shaft is urged in the direction opposite of the last direction of rotation.

15. The method of claim 14 wherein in step (e) the motor shaft rotates in a clockwise or in a counterclockwise direction dependant on the direction of current applied to the motor the direction dictated by the timer settings.

16. The method of claim 14 wherein in step (d), the direction of rotation is controlled by a relay control circuit having a pair of contact sets; One contact set normally open and the other normally closed.

17. The method of claim 14 wherein the coupling of the motor shaft to the temperature control shaft is achieved by fitting a notch provided on the free end of the coupler to a protuberance on the temperature control shaft.

18. A method for automatically turning a gas water heater on and off using an actuator mounted to a gas valve of the water heater and engaging a temperature control shaft of the gas valve by virtue of a coupler affixed at one end to a motor shaft of a motor integral to the actuator, the coupler having a notch disposed on the end opposite of the motor shaft, the notch engaging a protuberance on the temperature control shaft, the actuator connected to a relay control circuit controlled by programmable timer comprising the steps:

(a) reaching a first pre-programmed time point on the timer;

(b) energizing the relay control circuit to close a first contact set, the first contact set connected to a first terminal of the motor, closing thereof causing current to flow from a connected power supply to the first terminal driving the motor and rotating the motor shaft and temperature control shaft in a first direction;

(c) activating a first switch mounted in close proximity to the motor, activation thereof interrupting current flow from the power supply to the first terminal of the motor preventing further rotation of the motor shaft and temperature control shaft in the first direction;

(d) reaching a second pre-programmed time point on the timer;

(e) de-energizing the relay control circuit to close a second contact set while opening the first contact set, the second contact set connected to a second terminal of the motor, closing thereof causing current to flow from the power supply to the second terminal driving the motor and rotating the motor shaft and temperature control shaft in a second direction;

(f) activating a second switch mounted in close proximity to the motor, activation thereof interrupting current flow from the power supply to the second terminal of the motor preventing further rotation of the motor shaft and temperature control shaft in the second direction.

19. The method of claim 18 wherein in step (a) reaching the first pre-programmed time causes the timer to turn on and in step (d) reaching the second pre-programmed time causes the timer to turn off.

20. The method of claim 18 wherein in steps (c) and (f) the first and second switches are activated by an activation arm adjustably affixed to the motor shaft.

* * * * *